US008144018B1

(12) United States Patent
Leone et al.

(10) Patent No.: US 8,144,018 B1
(45) Date of Patent: Mar. 27, 2012

(54) COMBINATION ELECTRONIC ARTICLE SURVEILLANCE/RADIO FREQUENCY IDENTIFICATION ANTENNA AND METHOD

(75) Inventors: Steven V. Leone, Lake Worth, FL (US); Larry K. Canipe, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 1028 days.

(21) Appl. No.: 12/043,581

(22) Filed: Mar. 6, 2008

(51) Int. Cl.
*G08B 13/14* (2006.01)

(52) U.S. Cl. ..... 340/572.7; 340/572.1; 340/568.1

(58) Field of Classification Search ..... 340/568.1, 340/568.4, 572.1, 572.4, 572.7, 572.8; 235/383, 235/462.13, 487
See application file for complete search history.

(56) References Cited

U.S. PATENT DOCUMENTS

| | | | | |
|---|---|---|---|---|
| 5,939,984 | A * | 8/1999 | Brady et al. | 340/572.1 |
| 7,084,770 | B2 * | 8/2006 | Brady et al. | 340/572.7 |
| 7,559,467 | B2 * | 7/2009 | Scheb | 235/383 |
| 7,859,410 | B2 * | 12/2010 | Arguin | 340/572.1 |
| 2009/0189768 | A1 * | 7/2009 | Copeland et al. | 340/572.7 |

* cited by examiner

*Primary Examiner* — Van T. Trieu
(74) *Attorney, Agent, or Firm* — Alan M. Weisberg; Christopher & Weisberg, P.A.

(57) ABSTRACT

A combination EAS/RFID antenna for use in an EAS/RFID surveillance system. The antenna includes an EAS antenna element and an RFID antenna element. The EAS antenna element includes an EAS loop antenna defining an interior portion. The RFID antenna element includes an RFID patch antenna having a hatched conductor pattern. The RFID antenna element is situated proximate the EAS loop antenna in such a fashion that the overall size of the antenna is reduced.

20 Claims, 5 Drawing Sheets

COMBINATION ELECTRONIC ARTICLE SURVEILLANCE/RADIO FREQUENCY IDENTIFICATION ANTENNA AND METHOD

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention generally relates to electronic security systems, and in particular, to an antenna design that combines electronic article surveillance ("EAS") and radio frequency identification ("RFID") features in such a fashion that the overall size of the antenna is reduced.

BACKGROUND OF THE INVENTION

Electronic article surveillance ("EAS") systems are detection systems that allow the identification of a marker or tag within a given detection zone. EAS systems have many uses, but most often they are used as security systems for preventing shoplifting in stores or removal of property in office buildings. EAS systems come in many different forms and make use of a number of different technologies.

A typical EAS system includes an electronic detection unit, tags and/or markers, and a detacher or deactivator. The detection units can, for example, be formed as pedestal units, buried under floors, mounted on walls, or hung from ceilings. The detection units are usually placed in high traffic areas, such as entrances and exits of stores or office buildings. The tags and/or markers have special characteristics and are specifically designed to be affixed to or embedded in merchandise or other objects sought to be protected. When an active tag passes through a tag detection zone, the EAS system sounds an alarm, a light is activated and/or some other suitable alert devices are activated to indicate the removal of the tag from the prescribed area.

Common EAS systems operate with these same general principles using either transceivers, which each transmit and receive, or a separate transmitter and receiver. Typically the transmitter is placed on one side of the detection zone and the receiver is placed on the opposite side of the detection zone. The transmitter produces a predetermined excitation signal in a tag detection zone. In the case of a retail store, this detection zone is usually formed at an exit. When an EAS tag enters the detection zone, the tag has a characteristic response to the excitation signal, which can be detected. For example, the tag may respond to the signal sent by the transmitter by using a simple semiconductor junction, a tuned circuit composed of an inductor and capacitor, soft magnetic strips or wires, or vibrating magneto acoustic resonators. The receiver subsequently detects this characteristic response. By design, the characteristic response of the tag is distinctive and not likely to be created by natural circumstances.

Radio-frequency identification ("RFID") systems are also generally known in the art and may be used for a number of applications, such as managing inventory, electronic access control, security systems, and automatic identification of cars on toll roads. An RFID system typically includes an RFID reader and an RFID device. The RFID reader may transmit a radio-frequency ("RF") carrier signal to the RFID device. The RFID device may respond to the carrier signal with a data signal encoded with information stored by the RFID device.

The market need for combining EAS and RFID functions in the retail environment is rapidly emerging. Many retail stores that now have EAS for shoplifting protection rely on bar code information for inventory control. RFID offers faster and more detailed inventory control over bar coding. Retail stores already pay a considerable amount for hard tags that are re-useable. Adding RFID technology to EAS systems can easily pay for the added cost due to improved productivity in inventory control as well as loss prevention.

In addition, in order to minimize interactions between the EAS and RFID elements, prior art combination approaches have placed the two different elements, i.e., the EAS element and the RFID element, far enough apart in an end-to-end, a side-by-side or a stacked manner so as to minimize the interaction of each element. However, this requires a significant increase in the overall size and footprint of the combination antenna.

Recent attempts to reduce the overall size and footprint of combined EAS and RFID elements and create an antenna having both EAS and RFID capabilities have encountered further difficulties. For example, trying to make EAS and UHF RFID antennas work together in the same space is difficult because the RFID antennas are often designed as a patch antenna that requires a large ground plane.

EAS antennas are often designed as a loop antenna. It is advantageous to place an RFID patch antenna inside the EAS loop antenna. However, problems arise when this is done since the EAS transmit field is significantly attenuated due to the creation of eddy currents in the RFID ground plane which oppose the EAS field. While alternate antenna designs are not subject to the aforementioned problem if the RFID antenna is a dipole or helix coil type antenna, this alternate design does not allow for patch antennas.

What is needed is a combination EAS and RFID antenna design that will allow the placement of the EAS and the RFID elements in close proximity to each other in order to reduce the overall size of the antenna while at the same time reducing the attenuation effects eddy currents.

SUMMARY OF THE INVENTION

The present invention advantageously provides a combination EAS/RFID antenna design that includes both EAS and RFID elements in such a fashion that the overall size of the antenna is reduced. An EAS loop antenna is combined with an RFID patch antenna in an EAS/RFID system. A hatching pattern is applied to the RFID ground plane and/or patch antenna. The hatched RFID antenna is situated proximate an EAS loop antenna. The RFID ground plane can be situated within the inside area of the EAS loop antenna to further reduce the footprint taken up by the combination antenna.

In one aspect of the invention, a combination electronic article surveillance/radio frequency identification antenna is provided where the antenna includes an EAS loop antenna defining an interior portion, and an RFID antenna element having an RFID patch antenna, where the RFID patch antenna has a hatched conductor pattern. The RFID antenna element being positioned proximate the EAS antenna element.

In another aspect, the present invention provides a combination electronic article surveillance/radio frequency identification antenna in which an EAS loop antenna has an interior portion. An RFID antenna element has an RFID patch antenna, a ground plane and a dielectric element positioned between the RFID patch antenna and the ground plane. The RFID patch antenna has a hatched conductor pattern. The RFID antenna element is situated substantially coplanar and within the interior portion of the EAS loop antenna.

In yet another embodiment, the present invention provides a combination electronic article surveillance/radio frequency identification reader in which transmit circuitry is configured to output an interrogation signal The interrogation signal includes at least one of an EAS signal and an RFID signal. Receive circuitry is configured to receive a response signal in response to the interrogation signal. An EAS loop antenna transmits the EAS signal which the EAS loop antenna has an interior portion. An RFID antenna element includes an RFID patch antenna to transmit the RFID signal. The RFID patch antenna has a hatched conductor pattern. The RFID antenna element is positioned proximate the EAS loop antenna.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

The present invention is directed toward an antenna design having both EAS and

RFID elements. The antenna combines an EAS loop antenna with an RFID patch antenna and can be used in EAS/RFID systems such as combination handheld readers, tabletop deactivators and pedestals. A hatching pattern is applied to an RFID ground plane and patch antenna. The RFID antenna includes a ground plane, a dielectric element and a patch. The hatched RFID antenna is situated proximate an EAS loop antenna. In one embodiment, the RFID patch antenna is situated within the EAS loop antenna. In this embodiment, the RFID ground plane is substantially coplanar with and situated within the inside area of the EAS loop antenna. In another embodiment, the RFID antenna is substantially non-coplanar with respect to the EAS loop antenna and is situated in front of or behind the EAS loop antenna. In another embodiment, one or both of the RFID patch and the ground plane is etched in one of a variety of hatched conductor patterns.

Figure 1:
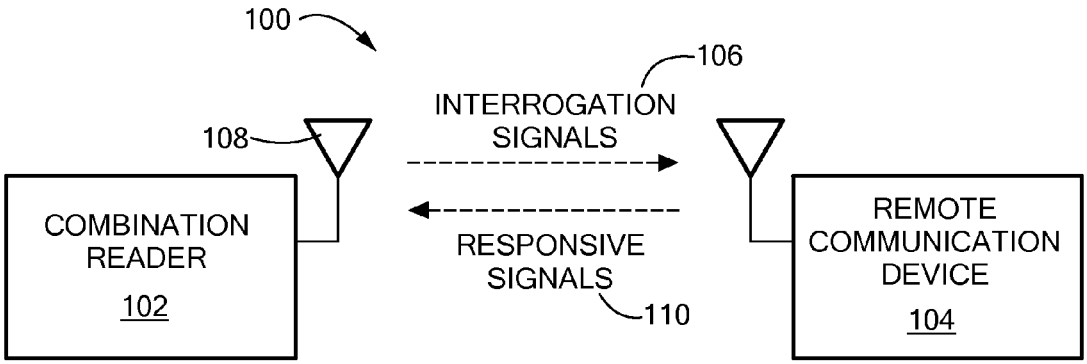
FIG. 1 is a block diagram of a combination electronic article surveillance/radio frequency identification detection system constructed in accordance with the principles of the present invention.

In another embodiment, both the RFID patch and the ground plane are hatched in one of a variety of hatching patterns. Referring now to the drawing figures in which like reference designators refer to like elements, there is shown in FIG. 1 a diagram of an exemplary system constructed in accordance with the principles of the present invention and designated generally as "100". FIG. 1 illustrates a system that includes a combination EAS/RFID reader 102 and one or more remote communication devices (tags) 104 affixed to one or more items. Although only one reader 102 and one tag 104 are shown in FIG. 1, the invention is not so limited and may include any number of these devices.

System 100 represents a surveillance system that combines the theft prevention features of an EAS security system with the item identification features of an RFID identification system. System 100 has the capability of alerting staff employees of a potential theft while the customer is still inside the store. Combining EAS technology with RFID technology can potentially provide manufacturers great benefit since they can use RFID to track inventory through the supply chain and use EAS to secure items on the retail floor.

Referring again to FIG. 1, the combination EAS/RFID reader 102 could be in the form of, for example, a reader unit used to transmit interrogation signals 106 to tag 104. Reader 102 can include a radio frequency module (transmitter and receiver), a control unit, a coupling element to the tags, and a power supply. Additionally, many readers are equipped with interface hardware to enable them to send data received from the tags to another system, e.g., PC, automatic control systems, etc.

Reader 102 includes a combination EAS/RFID antenna 108 having both EAS elements and RFID elements. The antenna 108 emits radio signals to activate the tag 104 and read and/or write data to it. Antenna 108 provides the conduit between the tag 104 and the reader 102, which controls the system's data acquisition and communication. The electromagnetic field produced by antenna 108 is constantly present if multiple tags are continually passing through the interrogation zone. If constant interrogation is not an application requirement, then a sensing device can activate the electromagnetic field thereby conserving power.

Tag 104 is an electronic transmitter/responder, typically placed on or embedded within an object, representing the actual data-carrying device of an EAS/RFID interrogation system. Tag 104 responds to a transmitted or communicated request signal 106 for its encoded data from an interrogator, i.e., reader 102. Tags 104 emit wireless signals over an open air interface using radio frequency waves to communicate with one another. Tags include an EAS element such as an acousto-magnetic ("AM") component and/or an active or passive RFID component.

The reader 102 emits radio waves in an interrogation range, the range varying depending upon the power output and the frequency used. As a tag 104 enters and passes through the electromagnetic zone, it senses the reader's activation signal. Reader 102 then decodes the encoded data within the tag's integrated circuit (IC) and passes the data to a host computer for processing.

Typically, the antenna 108 is packaged with the transceiver and decoder in reader 102. EAS/RFID reader 102 can be a hand-held device or in a fixed-position/fixed-mount configuration depending upon the desired application. Antenna 108 includes an EAS loop antenna and an RFID patch antenna, each of which is described in greater detail below. Antenna 108 is capable of transmitting EAS and/or RFID interrogation signals 106 to tag 104 and is also capable of receiving responsive communication signals 110 from tag 104.

Figure 2:
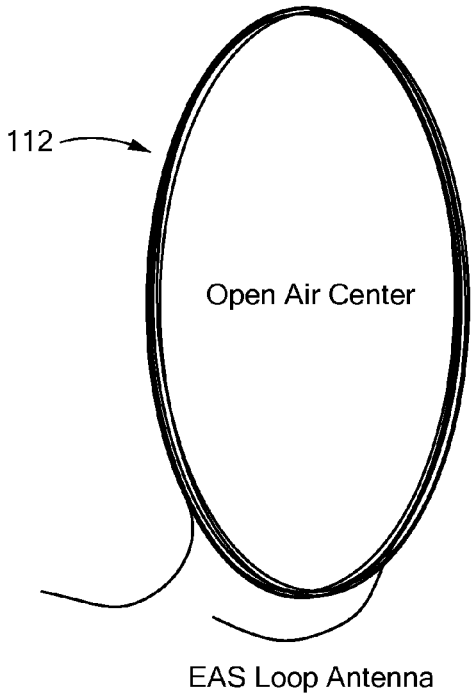
FIG. 2 is a front view of an EAS loop antenna used in the combination electronic article surveillance/radio frequency identification detection system of FIG. 1.

In FIG. 2, an EAS loop antenna 112 is shown. As discussed above, combination EAS/RFID antenna 108 has both an EAS element and an RFID element. EAS loop antenna 112 represents the EAS element of antenna 108. EAS loop antenna 112 is typically of a generally circular or rectangular shape and is driven by transmitter circuitry when EAS loop antenna 112 is used as a transmitting antenna. EAS loop antenna 112 is also electrically coupled to and drives receiver circuitry when the antenna is used as a receiver antenna. In addition to the antenna configuration depicted in FIG. 2, other loop sizes, shapes or configurations could be employed and used with the present invention. Current can flow in EAS loop antenna 112 in either a clockwise or counterclockwise direction.

Current flowing through the loop of EAS antenna 112 establishes a magnetic field having magnetic flux extending concentrically from at least a portion of the antenna and generally perpendicular to the current flow direction as is well known in the art. A current source electrically coupled to EAS loop antenna 112 supplies current to antenna 112 which is capable of supplying sufficient current to the antenna 112 for developing fields of electromagnetic energy. The current source can be a conventional transmitter having a signal oscillator and a suitable amplifier/filter network of a type capable of driving the load impedance presented by EAS loop antenna 112. As will be appreciated, the frequency at which antenna 112 radiates electromagnetic fields substantially depends on the oscillation rate of the transmitter. Thus, the frequency may be set and adjusted by appropriately adjusting the transmitter in a well-known manner.

In addition, receiver circuitry may be electrically coupled EAS loop antenna 112 for receiving electromagnetic energy from a transmitting antenna and/or the resonant circuit of a tag for generating a signal indicative of whether a tag is present in the vicinity of EAS loop antenna 112.

Figure 3:
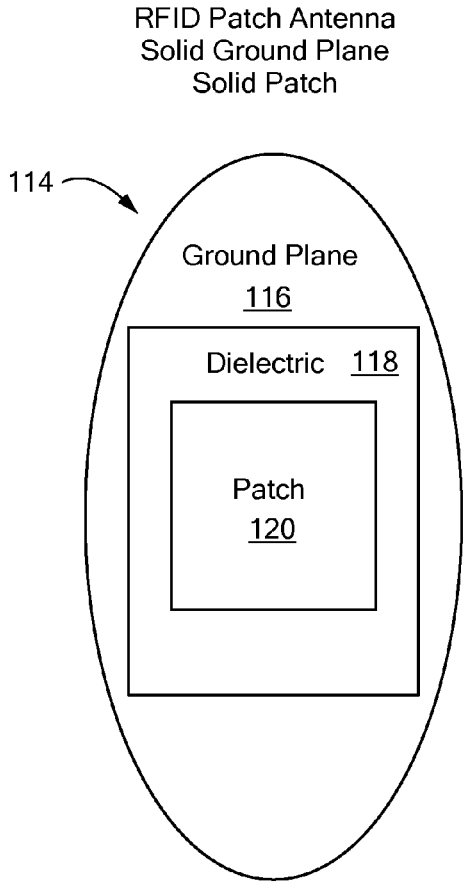
FIG. 3 is a front view of an RFID patch antenna used in the combination electronic article surveillance/radio frequency identification detection system of FIG. 1.
Figure 4:
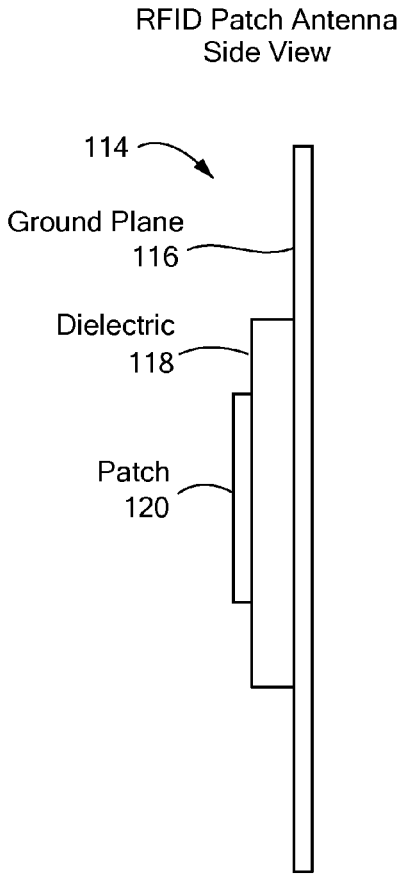
FIG. 4 is a side view of the RFID patch antenna of FIG. 3.

In FIGS. 3 and 4, an embodiment of an RFID patch antenna 114 used in accordance with the present invention is shown. In one embodiment, RFID patch antenna 114 includes a ground plane 116, upon which is situated a dielectric element 118. A patch antenna 120 is situated on dielectric element 118. The embodiment depicted in FIGS. 3 and 4 is exemplary only and other configurations of the RFID patch antenna can be used.

Figure 5:
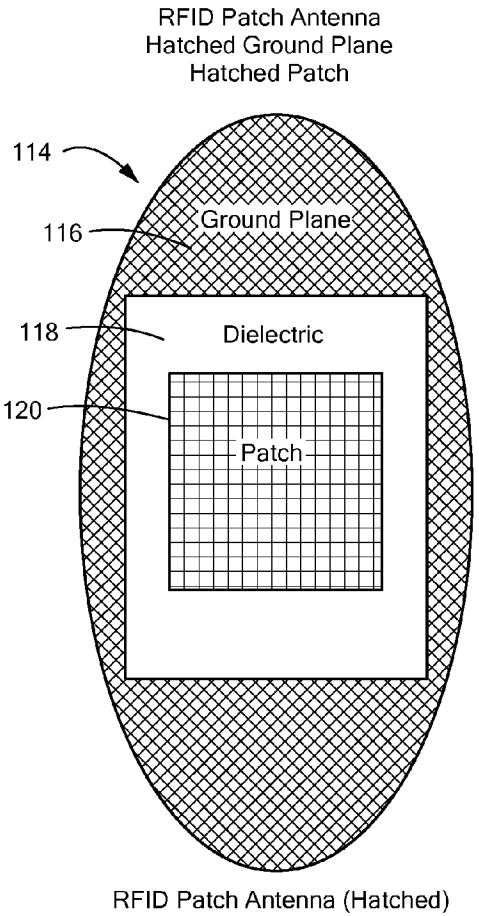
FIG. 5 is a front view of an RFID patch antenna having a hatched pattern and used in the combination electronic article surveillance/radio frequency identification detection system of FIG. 1.

FIG. 5 illustrates an embodiment of the present invention where RFID patch antenna 114 includes a hatch pattern in ground plane 116 and also in patch 120. In another embodiment, the hatch pattern exists only in patch 120. In yet another embodiment, only ground plane 116 includes a hatch pattern. The hatch pattern depicted in FIG. 5 represents a segmentation of conductors throughout the patch antenna 120 and/or ground plane 116 such as by etching during the fabrication process. The discontinuity of the conductors minimizes the eddy currents that are produced by EAS loop antenna 112 by dividing up the planes to the EAS frequencies produced by the EAS loop antenna signal transmissions.

Figure 6:
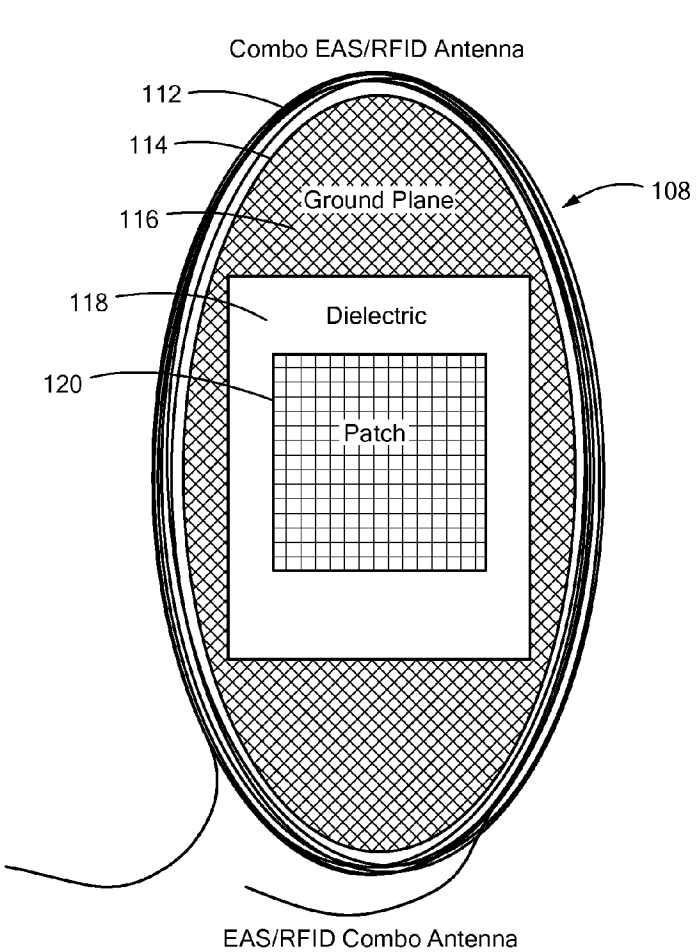
FIG. 6 is a front view of a combination EAS/RFID antenna used in the combination electronic article surveillance/radio frequency identification detection system of FIG. 1.

FIG. 6 illustrates a hatched RFID antenna 114, which includes both a hatched ground plane 116 and a hatched patch 120, substantially coplanar with respect to EAS loop antenna 112. In this embodiment, RFID antenna 114 is positioned within the interior of EAS loop antenna 112. The result is a combination antenna 108 with both RFID and EAS transmission capability, having a reduced overall footprint. The combination antenna 108 advantageously takes up less space than other combination antennas thus allowing the antenna 108 to be incorporated within readers, pedestals, tabletops and other locations where other combination antennas would not fit. In other embodiments, RFID patch antenna 114 is situated proximate EAS loop antenna 112 but not within it. For example, RFID patch antenna 114 could be non-coplanar with respect to EAS loop antenna 112 such as situated behind or in front of EAS loop antenna 112. The result in these configurations is a combination antenna 108 with a reduced footprint when compared to other combination antennas. The segmentation or discontinuous pattern or screen of the hatched design serves to divide up the EAS frequencies while allowing the transmission frequencies of the RFID antenna to be unaffected.

The hatch designs shown in FIGS. 5 and 6 are illustrative only and the invention are not limited to a particular hatch design. In one embodiment, the RFID antenna 114 is situated within the interior of EAS loop antenna 112, thereby keeping the overall size of the combination antenna to a minimum, which allows it to be embedded within small readers, pedestals and the like. Further, despite the close proximity of the RFID antenna 114 and EAS loop antenna 112, the attenuation of the EAS transmission field due to eddy currents is reduced by the segmentation of the RFID hatch pattern.

Figure 7:
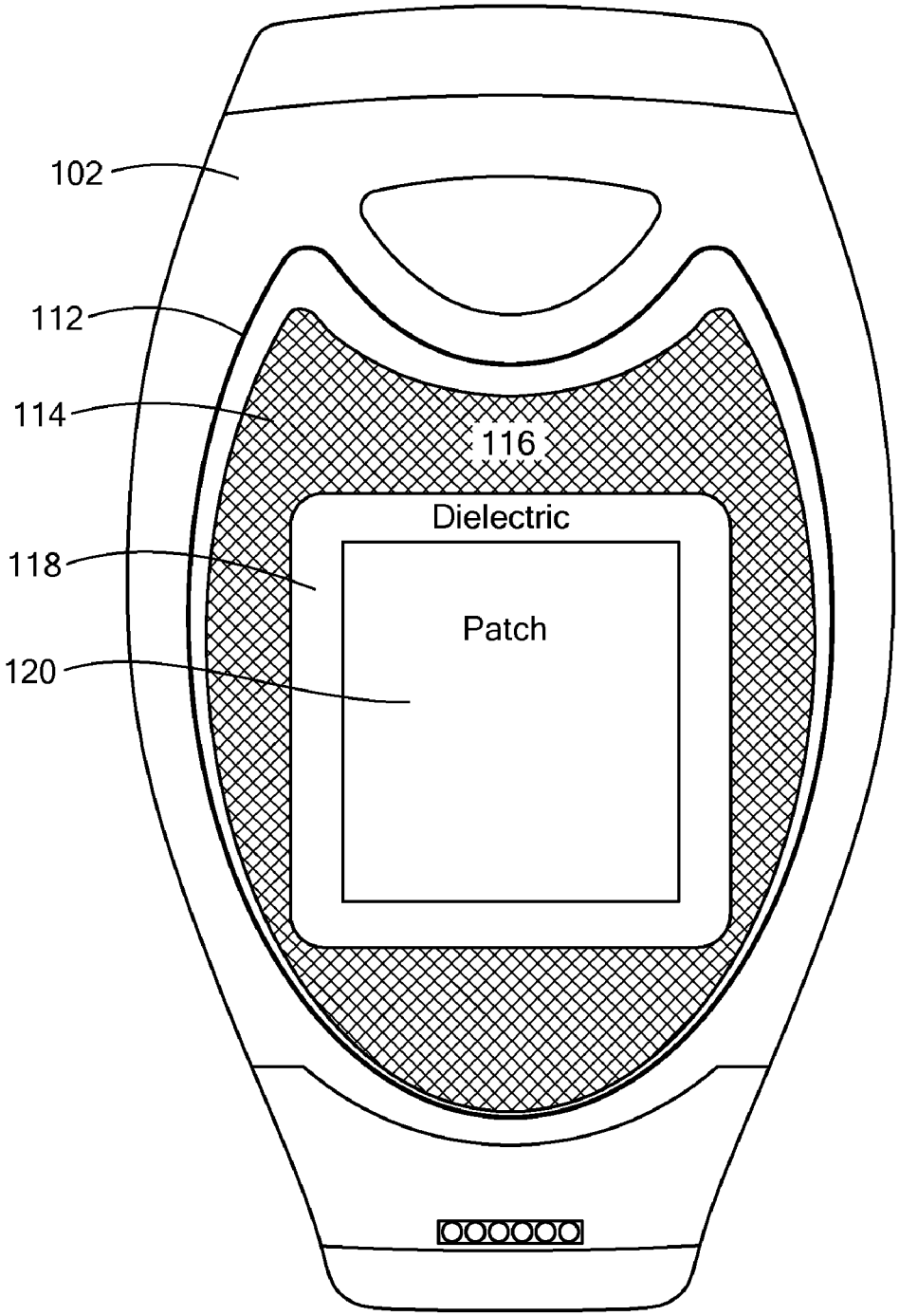
FIG. 7 is a front view of a handheld reader having the combination EAS/RFID antenna of FIG. 6.
Figure 8:
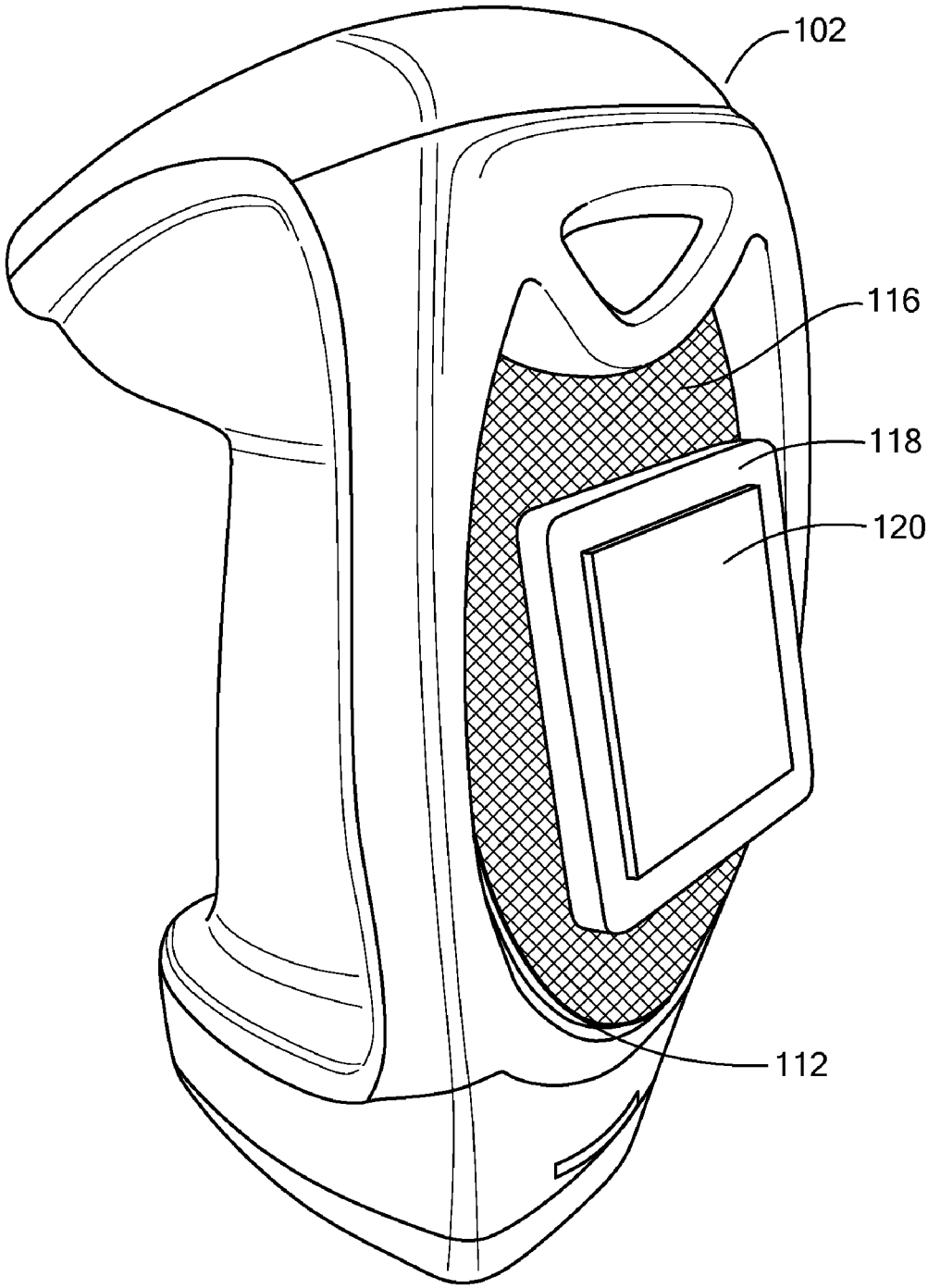
FIG. 8 is a perspective view of a handheld reader having the combination EAS/RFID antenna of FIG. 6.

FIGS. 7 and 8 illustrate an embodiment of the present invention where a hand-held reader 102 includes transmit circuitry configured to output an interrogation signal. The interrogation signal includes at least one of an EAS signal and an RFID signal. Reader 102 also includes receive circuitry configured to receive a response signal in response to the interrogation signal. Reader 102 further includes an EAS loop antenna 112 for transmitting the EAS signal, where the EAS loop antenna 112 defines an interior portion, and an RFID antenna element having an RFID patch antenna 114 for transmitting the RFID signal, where the RFID patch antenna 114 is positioned within the interior of the open loop EAS antenna 112. Hatched ground plane 116, dielectric 118, and patch 120 can be clearly seen with in the interior of EAS loop antenna 112. This embodiment shows a hand-held reader 102 with a non-hatched patch 120. However, hand-held reader 102 can include a patch 120 having a hatched pattern much like the pattern of ground plane 116. Alternately, ground plane 116 could have a hatch pattern that is different from the hatch pattern of patch 120.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed:

1. A combination electronic article surveillance/radio frequency identification antenna, the antenna comprising:

an EAS loop antenna defining an interior portion; and an RFID antenna element, the RFID antenna element including an RFID patch antenna, the RFID patch antenna having a hatched conductor pattern, the RFID antenna element being positioned proximate the EAS loop antenna.

2. The combination EAS/RFID antenna of claim 1, wherein the RFID antenna element is substantially non-coplanar with respect to the EAS loop antenna.

3. The combination EAS/RFID antenna of claim 1, wherein the RFID antenna element is substantially coplanar with respect to the EAS loop antenna.

4. The combination EAS/RFID antenna of claim 1, wherein the RFID antenna element is situated substantially within the interior portion of the EAS loop antenna.

5. The combination EAS/RFID antenna of claim 1, wherein the RFID antenna element further includes a ground plane and a dielectric element, the dielectric element positioned between the ground plane and the RFID patch antenna.

6. The combination EAS/RFID antenna of claim 5, wherein the ground plane includes a hatched conductor pattern.

7. The combination EAS/RFID antenna of claim 6 wherein the hatched conductor pattern of the ground element is different from the hatched conductor pattern of the RFID patch antenna.

8. The combination EAS/RFID antenna of claim 6, wherein the hatched conductor pattern of the ground element is the same as the hatched conductor pattern of the RFID patch antenna.

9. A combination electronic article surveillance/radio frequency identification antenna, the antenna comprising:

an EAS loop antenna defining an interior portion; and an RFID antenna element, the RFID antenna element comprising:

an RFID patch antenna, the RFID patch antenna having a hatched conductor pattern, a ground plane; and a dielectric element positioned between the RFID patch antenna and the ground plane, the RFID antenna element being situated substantially coplanar and within the interior portion of the EAS loop antenna.

10. The combination EAS/RFID antenna of claim 9, wherein the ground plane includes a hatched conductor pattern.

11. The combination EAS/RFID antenna of claim 10, wherein the hatched conductor pattern of the ground plane is different from the hatched conductor pattern of the RFID patch antenna.

12. The combination EAS/RFID antenna of claim 10, wherein the hatched conductor pattern of the ground plane is the same as the hatched conductor pattern of the RFID patch antenna.

13. A combination electronic article surveillance/radio frequency identification reader, the reader comprising:

transmit circuitry configured to output an interrogation signal, the interrogation signal including at least one of an EAS signal and an RFID signal;

receive circuitry configured to receive a response signal in response to the interrogation signal;

an EAS loop antenna for transmitting the EAS signal, the EAS loop antenna defining an interior portion; and an RFID antenna element, the RFID antenna element including an RFID patch antenna for transmitting the RFID signal, the RFID patch antenna having a hatched conductor pattern, the RFID antenna element being positioned proximate the EAS loop antenna.

14. The combination EAS/RFID reader of claim 13, wherein the RFID antenna element is substantially non-coplanar with respect to the EAS loop antenna.

15. The combination EAS/RFID reader of claim 13, wherein the RFID antenna element is substantially coplanar with respect to the EAS loop antenna.

16. The combination EAS/RFID reader of claim 13, wherein the RFID antenna element is situated substantially within the interior portion of the EAS loop antenna.

17. The combination EAS/RFID reader of claim 13, wherein the RFID antenna element further includes a ground plane and a dielectric element, the dielectric element positioned between the ground plane and the RFID patch antenna.

18. The combination EAS/RFID reader of claim 17, wherein the ground plane includes a hatched conductor pattern.

19. The combination EAS/RFID reader of claim 18, wherein the hatched conductor pattern of the ground element is different from the hatched conductor pattern of the RFID patch antenna.

20. The combination EAS/RFID reader of claim 18, wherein the hatched conductor pattern of the ground element is the same as the hatched conductor pattern of the RFID patch antenna.

* * * * *